US005119733A

United States Patent [19]

Brochand

[11] Patent Number: 5,119,733

[45] Date of Patent: Jun. 9, 1992

[54] TENSION TERMINAL STATION OF A CABLE TRANSPORT INSTALLATION

[75] Inventor: Max Brochand, Noyarey, France

[73] Assignee: Pomagalski S.A., France

[21] Appl. No.: 631,963

[22] Filed: Dec. 21, 1990

[30] Foreign Application Priority Data

Apr. 24, 1990 [FR] France ..... 90 05309

[51] Int. Cl.[5] ..... B61B 11/00

[52] U.S. Cl. ..... 104/112; 104/27; 104/87

[58] Field of Search ..... 104/112, 117, 27, 28, 104/173.1, 173.2, 87, 196, 178

[56] References Cited

U.S. PATENT DOCUMENTS

| | | | |
|---|---|---|---|
| 1,109,371 | 9/1914 | Thunhart | 104/117 X |
| 3,377,959 | 4/1968 | Hawes | 104/117 |
| 3,728,972 | 4/1973 | Goforth et al. | 104/117 |
| 4,003,314 | 1/1977 | Pearson | 104/173.2 X |
| 4,470,355 | 9/1984 | Kunczynski | 104/117 X |
| 4,627,361 | 12/1986 | Tarassoff | 104/173.2 X |
| 4,641,584 | 2/1987 | Bertrand | 104/173.2 |
| 4,699,064 | 10/1987 | Tarassoff | 104/173.2 X |
| 4,712,486 | 12/1987 | Tarassoff | 104/27 X |
| 4,782,761 | 11/1988 | Asberg | 104/173.1 X |
| 4,794,864 | 1/1989 | Feuz et al. | 104/173.2 X |
| 4,843,968 | 7/1989 | Rikli | 104/28 X |
| 4,843,970 | 7/1989 | Feuz | 104/28 X |

FOREIGN PATENT DOCUMENTS

| | | | |
|---|---|---|---|
| 2605574 | 4/1988 | France | 104/28 |

*Primary Examiner*—Margaret A. Focarino
*Assistant Examiner*—Joseph D. Pape
*Attorney, Agent, or Firm*—Parkhurst, Wendel & Rossi

[57] ABSTRACT

A tension station of a detachable chairlift or gondola lift includes a sliding carriage which supports both the return pulley or drive pulley and transfer rail with the associated drive mechanism which drives the cars of the cable transport installation. The carriage is mounted such that it may slide along a longitudinal axis between the tension station and another station.

10 Claims, 2 Drawing Sheets

TENSION TERMINAL STATION OF A CABLE TRANSPORT INSTALLATION

BACKGROUND OF THE INVENTION

The invention relates to a tension terminal station of an overhead carrier-hauling cable transport installation, extending in a closed loop along the line between two stations and to which cars running between the two stations are suspended by coupling grips.

At least one of the stations includes a return pulley on which said cable passes;

a disengagement device of the cars at the entrance to the station;

an engagement device of the cars at the exit from the station;

a transfer rail extending in the extension of the line in the station, to guide the cars detached from the cable from the entrance to the exit of the station, passing on loading and/or unloading platforms, the rail is in the shape of a half-loop passing round the pulley;

a support carriage of the pulley which is slidably mounted on a longitudinal axis of the line connecting the two stations;

a tension device biasing the carriage in the tension direction of the carrier-hauling cable.

The invention is described hereafter as being applied to a detachable chairlift, but it is clear that it can be applied to other similar installations, such as gondola lifts or bucket cableways.

The stations of the kind mentioned are equipped with devices to vary the length of the line in terms of the load to keep the tension of the carrier-hauling cable appreciably constant. To achieve this, the support carriage of the return pulley may slide, due to the action of a jack or any other tension system, in the longitudinal direction of the line. In certain installations, these sliding movements are great and require free space, which impose layout constraints of the other parts making up the station. In particular, the trajectory of a transfer rail, running round the return pulley, must be sufficiently long so as not to hinder the movements of the pulley and the length of the station may depend thereon. It has already been proposed to move the pulley toward the rear of the transfer rail, but this arrangement complicates the overall layout of the station.

SUMMARY OF THE INVENTION

The object of the present invention is to achieve a station with a simple structure allowing movements of the tension pulley. The present invention is characterized in that the transfer rail is supported by the carriage to move with the pulley and maintain a constant relative position between the pulley and the rail.

The tension pulley and transfer rail are mounted on the same sliding support and their constant relative position is thus perfectly well defined and is the best possible. This arrangement also facilitates driving of the drive means of the cars on the transfer rails, either by the return pulley or directly by the cable.

By mounting the disengagement and/or engagement devices and possibly the motor, when the pulley is the drive pulley, on the same support carriage of the pulley and transfer rail, all the active parts of the station are grouped together and fixed with respect to one another, which facilitates the overall layout.

The sliding carriage is advantageously a metal structure in the form of a frame having beams extending along the transfer rail, which is affixed thereto, notably by supports in the shape of a swan-neck. These supports also hold the drive means, for example the friction wheels, driving the cars on the rail. The carriage is supported by one or more pillars, preferably central, extending in the vertical plane containing the longitudinal axis of the station and of the line and supporting fixed support and guide rollers of the carriage. The rollers cooperate with internal girders or beams of the carriage which frame the pillars. Any other structure, notably suspended from the ceiling of a building, can naturally be used. The pulley and rail are preferably appreciably in the same horizontal plane, located at the same height as the line at the entrance to the station.

It is clear that the station can comprise a protective building or simply shelters or covers protecting certain parts.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
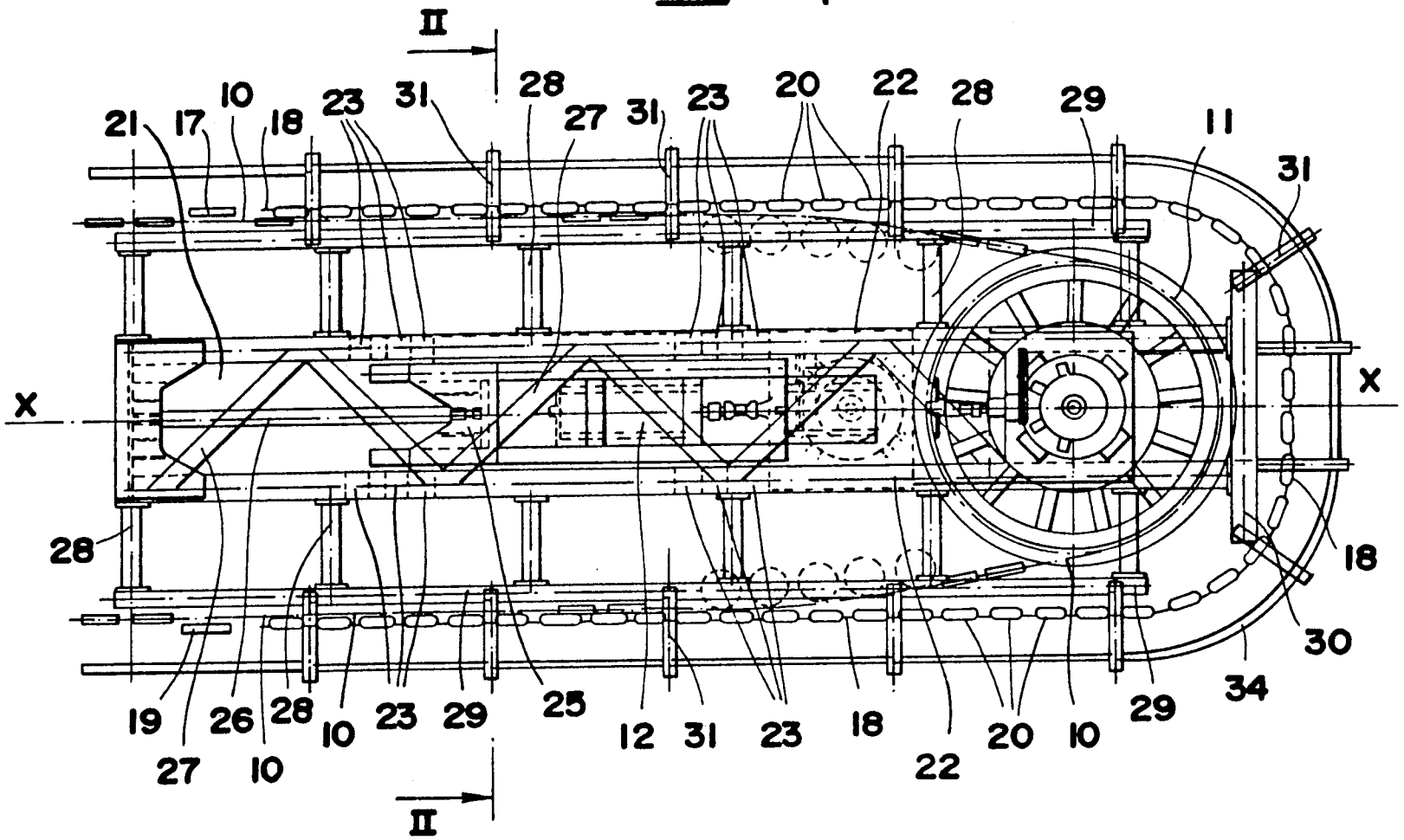
FIG. 1 is a plane view of a station according to the invention.
Figure 2:
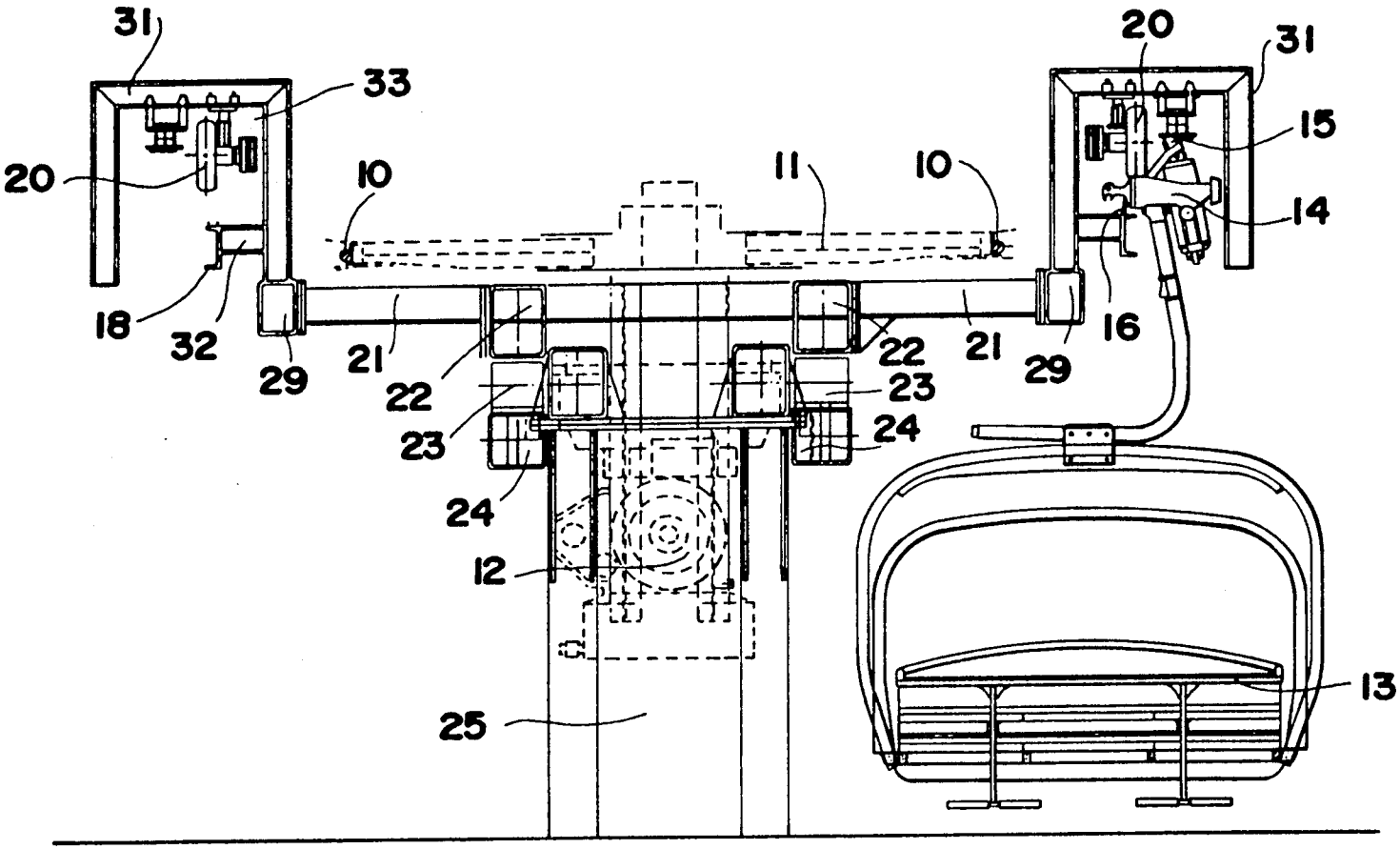
FIG. 2 is a cross-section according to the line II—II in FIG. 1.

In the figures, an overhead cable 10 of a single-cable chair lift, which could be a gondola lift or a similar single-cable transporter, runs in the station on a return pulley 11, driven in rotation by a motor 12. The chairs 13 are fixed to a grip 14 coupling them to the cable 10, having an operating lever 15 and roller wheels 16.

At the entrance to the station, a fixed disengagement ramp 17 uncouples the grip 14 from the cable 10, whereas the wheels 16 of the grip engage on a transfer rail 18 which passes in a half-loop around the pulley 11. The rail 18 extends up to the exit from the station where a fixed engagement ramp 19 recouples the grip to the cable 10. Along the rail 18 there are located trains of tired wheels 20 at intervals, which drive the grips 14 by friction to move the chairs 13 in the station and possibly to brake them and accelerate them respectively at the entrance and at the exit. Any other drive means, notably by a chain can naturally be used. Detachable chairlifts of this kind and their operation are well known.

According to the present invention, the vertical-axis pulley 11 is supported by an elongated carriage 21, mounted with sliding according to the longitudinal axis X—X of the station and of the line defined by the cable 10. In the embodiment represented in the figures, the carriage 21 comprises two upper internal girders 22 constituted by I-shaped sections and forming a rectangular frame bearing on fixed horizontal-axis rollers 23 perpendicular to the axis X—X. The base plates of the sections 22 roll on the rollers 23 to allow the carriage 21 to slide according to the axis X—X of the station. Two internal counter-beams 24 square to the carriage 21 cooperate with the bottom face of the rollers 23 to prevent any rocking of the carriage 21, which is guided in its movement by any appropriate means. The rollers 23 are located on either side of pillars 25 anchored to the ground and disposed in the axis X—X of the station.

A jack 26, located between a pillar 25 and the carriage 21, biases the carriage 21 in the opposite direction from the line to keep the cable 10 taut, but any other tension device can be used. The internal girders 22, 24 are secured by cross-members 27 to form a rigid support frame to which there are fixed, by small transverse girders 28, two external girders 29 extending parallel to the two straight longitudinal sections of the transfer rail 18. A straight or curved transverse girder 30 securedly united to the carriage 21 extends along the rear part of the transfer rail 18. Along the external girders 29 there are located at intervals swan-neck hoops 31 which are open downwards and overlap the transfer rail 18 which is affixed thereto by spacers 32. These hoops 31 or possibly the external girders 29, 30 also have affixed to them the engagement and disengagement ramps 17, 19 and the drive means of the chairs 13 on the transfer rail 18, in this case the friction wheels 20 with their support girders 33 and their drive devices which are not shown. The external branches of the hoops 31 can be connected by a belt 34 to form with the hoops 31 a support frame of a protective cover, not shown, of the transfer rail 18 and associated drive means. The friction wheels 20 can be driven by a separate motor supported by the carriage 21 or preferably by a power take-off on the cable 10 or pulley 11. The geared drive motor unit 12 of the pulley 11 is suspended from the carriage 21 being housed between the pillars 25 to participate in the stability of the assembly. If the return pulley 11 is not the drive pulley, the absence of the geared motor unit 12 simplifies the layout of the station.

It can be seen that the mobile carriage 21 supports the tension pulley 11, transfer rail 18, disengagement and engagement ramps 17, 19, motor unit 12 and drive means 20 of the chairs on the rail 18. All these components, which are the active parts of the station, are fixed with respect to one another, and their position, notably that of the transfer rail 18 with respect to the pulley 11, can be perfectly well defined. The entire assembly moves along the axis X—X to compensate for the load variations and the movement travel depends only on the length of the carriage 21. The length of the transfer rail 18 is determined only by the lengths of the acceleration and deceleration sections and those of the loading and/or unloading platforms, and this length is independent from the movement travel of the pulley 11.

The station can be incorporated in a building, but it is designed for use without any particular shelter. It is clear that the carriage 21 can be suspended from a support structure and that the pulley 11 can be located underneath the carriage 21, other layouts being conceivable. The carriage 21 can also be equipped with wheels that can run on fixed rails.

I claim:

1. A tension terminal station for an overhead cable transport apparatus which includes a closed loop cable and cars having coupling grips from which said cars suspend, said tension terminal station comprising:

a tension pulley around which said closed loop cable passes;

means for uncoupling said coupling grips thereby disengaging said cars from said closed loop cable;

means for coupling said coupling grips thereby engaging said cars with said closed loop cable;

a transfer rail extending substantially in a longitudinal direction corresponding to the extension direction of said closed loop cable, wherein said transfer rail guides said cars when disengaged from said closed loop cable, said transfer rail being the shape of a half loop which circumvents said tension pulley and said closed loop cable; and a slidably mounted support carriage which is movable in said longitudinal direction, said support carriage including a tension device for biasing said support carriage in said longitudinal direction, wherein said transfer rail and said tension pulley are supported by said support carriage, said tension device thereby providing tension to said closed loop cable.

2. The tension terminal station of claim 1, wherein said carriage supports said means for uncoupling and coupling said grips.

3. The tension terminal station of claim 1, further comprising a drive motor for driving said tension pulley, said drive motor being supported by said support carriage.

4. The tension terminal station of claim 1, further comprising means for driving said cars on said transfer rail, said means being supported by said support carriage.

5. The tension terminal station of claim 4, wherein said means for driving said cars comprises trains of tired wheels staggered along said transfer rail to drive said cars by friction.

6. The tension terminal station of claim 4, wherein said closed loop cable supplies power for driving said means for driving said cars.

7. The tension terminal station of claim 4, wherein said tension pulley supplies the power for driving said means for driving said cars.

8. The tension terminal station of claim 1, wherein said support carriage is attached to a frame comprising external beams which extend in said longitudinal direction, wherein said transfer rail is attached to said external beams.

9. The tension terminal station of claim 8, wherein said frame comprises at least two internal beams extending in said longitudinal direction, said internal beams being slidably mounted on rollers supported by pillars such that said rollers provide means for movement of said support carriage in said longitudinal direction.

10. The tension terminal station of claim 1, wherein said tension pulley and said transfer rail are arranged substantially in the same horizontal plane.

* * * * *